US008315417B2

(12) United States Patent
Basore

(10) Patent No.: US 8,315,417 B2
(45) Date of Patent: Nov. 20, 2012

(54) SHIPPABLE SPEAKER BOX

(76) Inventor: William Basore, Fountain Hills, AZ (US)

( * ) Notice: Subject to any disclaimer, the term of this patent is extended or adjusted under 35 U.S.C. 154(b) by 353 days.

(21) Appl. No.: 12/657,700

(22) Filed: Jan. 25, 2010

(65) Prior Publication Data

US 2010/0189294 A1 Jul. 29, 2010

Related U.S. Application Data

(60) Provisional application No. 61/205,791, filed on Jan. 23, 2009.

(51) Int. Cl.
*H04R 1/02* (2006.01)

(52) U.S. Cl. ..... 381/345; 381/87; 381/334; 381/335; 381/386; 181/148; 181/199

(58) Field of Classification Search ..... 381/345, 381/386, 87, 334–335; 181/148, 199
See application file for complete search history.

(56) References Cited

U.S. PATENT DOCUMENTS

| | | | | |
|---|---|---|---|---|
| 4,451,711 | A * | 5/1984 | Jackson | 381/335 |
| 5,696,357 | A * | 12/1997 | Starobin | 181/156 |
| 5,979,591 | A * | 11/1999 | Harrison | 181/199 |
| 7,967,104 | B2 * | 6/2011 | Carter | 181/199 |
| 2006/0165248 | A1 * | 7/2006 | Butcher et al. | 381/345 |

* cited by examiner

*Primary Examiner* — Yuwen Pan
*Assistant Examiner* — Matthew Eason
(74) *Attorney, Agent, or Firm* — Stuart Whittington, Esq

(57) ABSTRACT

A speaker box, or enclosure, and kit with five panels connected by flexible couplings is shipped in a stack of four of the five panels, plus two side panels. The flexible couplings may be provided by a single sheet of fabric coupled to the five panels. When the kit is assembled into a speaker box, the five coupled panels circumferentially engage the two side panels, which are shaped as isosceles trapezoids. One side of the assembled speaker box includes two coupled panels, of the five coupled panels, joined with a flat rabbet joint. The assembled speaker box is held together with bundle ties, adhesive, or preferably, both. Openings for a speaker and a connector cup are provided. The kit includes adhesive, instructions, bundle ties with bundle tie locks, a connector cup, and hardware.

20 Claims, 11 Drawing Sheets

SHIPPABLE SPEAKER BOX

CROSS-REFERENCE TO RELATED APPLICATIONS

This application claims benefit of priority under 35 U.S.C. 119(e) to provisional application Ser. No. 61/205,791 entitled Shippable Speaker Box, filed by the instant inventor on Jan. 23, 2009 which is fully incorporated herein by its reference.

FIELD OF THE INVENTION

The present invention relates to a box, or cabinet, for a loudspeaker, wherein the box has improved form for folding for shipment. The field of invention also relates to kits including the improved form, providing means to construct the shipped kit into a loudspeaker box.

BACKGROUND OF THE INVENTION

Speaker boxes have been known in art for many years, having a generally rectangular shape or having one sloped face. They are known to be covered in carpet or other fabric.

Continuing challenges in the art are to reduce the form factor for shipping and to increase the speed of assembly. Retail establishments that offer assembly services for their customers have very tight timelines for assemblies. For example, one major retailer allows only ten minutes to completely assemble a speaker box, using untrained personnel.

US Patent Publication 200610165248 A1 to Butcher, et al. published Jul. 27, 2007 is a useful example of the challenges. Butcher shows four aligned panels held together with living hinges which are intended to fold up into a stack for shipping. In fact the four panels, as taught by Butcher, cannot fold up for shipping because of the nature of the joints that Butcher uses. Products have been sold, allegedly patent pending under Butcher's application, that have two sets of two panels flexibly connected by living hinges. The four-panel stack does not work.

Hence, there is a need for a speaker box that can fold more sections completely and which can be quickly assembled by relatively unskilled personnel. There is also a need for a kit, based on a rapidly erectable speaker box that contains all associated parts and hardware to allow construction of a speaker box that is ready to receive a speaker. The present invention addresses these needs.

BRIEF DESCRIPTION OF THE SEVERAL VIEWS OF THE DRAWING

Aspects, features and advantages of the present invention will become apparent from the following description of the invention in reference to the appended drawing in which like numerals denote like elements and in which.

DETAILED DESCRIPTION OF THE INVENTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
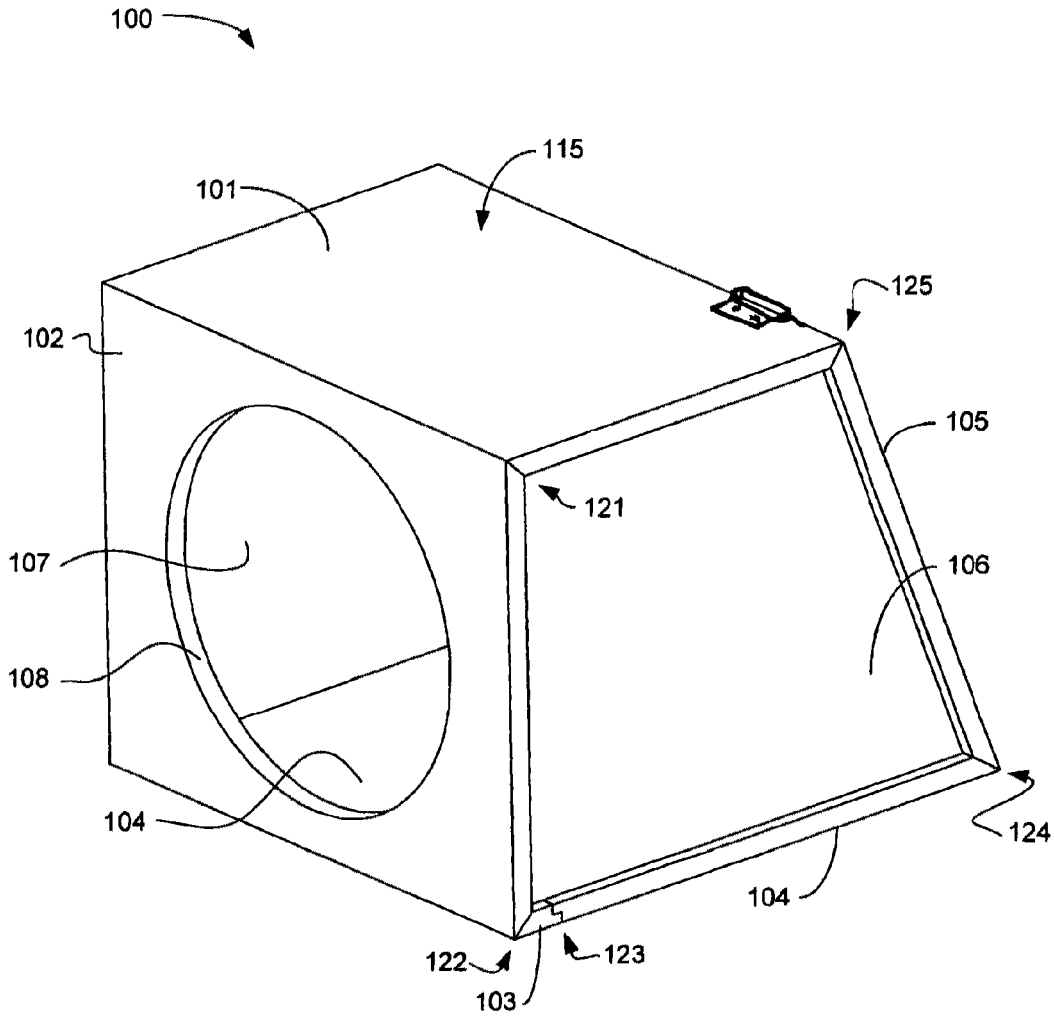
FIG. 1 is a front perspective view illustrating some aspects of the assembled improved shippable speaker box, according to an exemplary embodiment of the present invention.

FIG. 1 is a front perspective view illustrating some aspects of the assembled improved shippable speaker box 100, according to an exemplary embodiment of the present invention. The speaker box 100 includes a flexibly coupled set of five panels 101, 102, 103, 104 and 105 and two side panels 106 and 107. Panels 101,102 103,104, 105, 106 and 107 may be wood, composite, or other material. Materials with some acoustic damping properties to reduce cabinet buzz, are preferred. Panel 101 is the top of the speaker box 100, and is flexibly coupled at mitered joint 121 to panel 102, which is the front panel. Front panel 102 has a speaker opening 108 for receiving a speaker. The speaker is not included in this embodiment. In an alternate embodiment, the speaker box 100 may be sold with a speaker. Front panel 102 is flexibly coupled to short panel 103 at mitered joint 122. Short panel 103 enables stack folding of four panels 101, 102, 104, and 105 of the five panels 101,102,103 104, and 105. Short panel 103 is flexibly coupled to bottom panel 104 at flat mitered rabbet joint 123. Short panel 103 and bottom panel 104 form the bottom of speaker box 100. Bottom panel 104 is flexibly coupled to back panel 105 at acutely mitered joint 124. Back panel 105 is joined, as will be discussed further below, to top panel 101. Preferably, the five panels 101, 102, 103 104, and 105 are flexibly coupled by a single sheet of fabric 115. With separate sheets for panels 106 and 107, fabric 115 covers the exterior surfaces of all panels 101, 102, 103, 104,105, 106 and 107. Two panels 103 and 104 that are joined with the flat rabbet joint 123 form one bottom surface of the speaker box 100.

Side panel 106 has an isosceles trapezoidal shape and is circumferentially engaged by the five panels 101, 102, 103, 104 and 105. Four of the joints 121,122,124 and 125 between the five panels 101, 102, 103, 104 and 105 coincide with corners of the side panel 106. Side panel 107 is a mirror image of side panel 106 and is also circumferentially engaged by the five panels 101, 102, 103, 104 and 105. Together, the seven panels 101,102,103,104,105,106, and 107 form speaker box 100.

Figure 2:
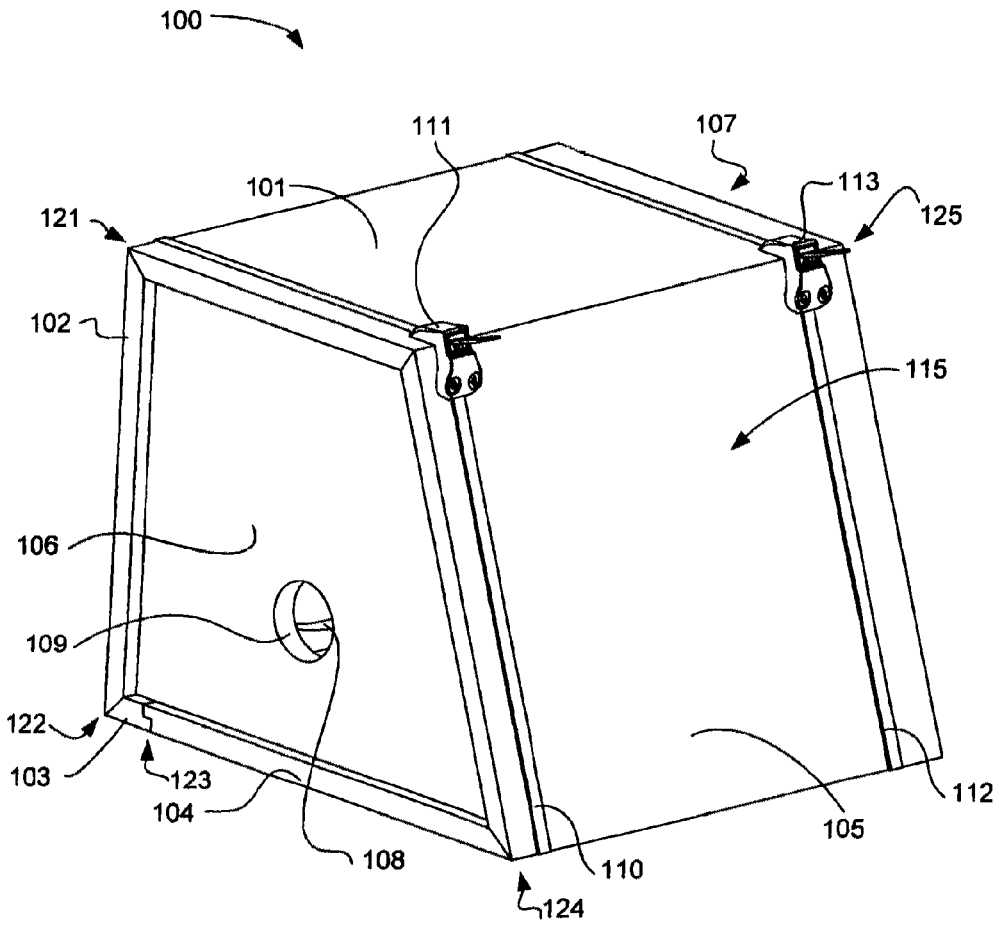
FIG. 2 is a rear perspective view illustrating additional aspects of the assembled improved shippable speaker box of FIG. 1, according to an exemplary embodiment of the present invention.

FIG. 2 is a rear perspective view illustrating additional aspects of the assembled improved shippable speaker box 100 of FIG. 1, according to an exemplary embodiment of the present invention. Panel 106 is shown with connector cup opening 109, which receives a connector cup 1102 (see FIG. 11). Connector cup 1102 snap fits into connector cup opening 109 with wire leads inside the speaker box 100. The wire leads couple to the audio signal terminals of the speaker, when installed, and provide terminals for an audio amplifier, or other audio signal source, in the recess of the cup, accessible from the outside of speaker box 100.

Bundle ties 110 and 112 assist in maintaining the structural integrity of the speaker box 100 after assembly. Bundle ties 110 and 112 also assist in compressing adhesive joints, to be discussed below, while the adhesive is drying, making for an improved adhesive bond. The locks, or clamps, 111 and 113 are coupled to panel 105 using fasteners that preferably extend through the fabric covering 115 and into or through panel 105. The bundle tie locks 111 and 113 are designed such that pulling a portion of the bundle tie 110 or 112 through the bundle tie lock 111 or 113, respectively, tightens the bundle tie 111 or 113, but does not allow loosening. Other parts of speaker box 100 in FIG. 2 use the same reference numbers as FIG. 1, as will subsequent figures.

Figure 3:
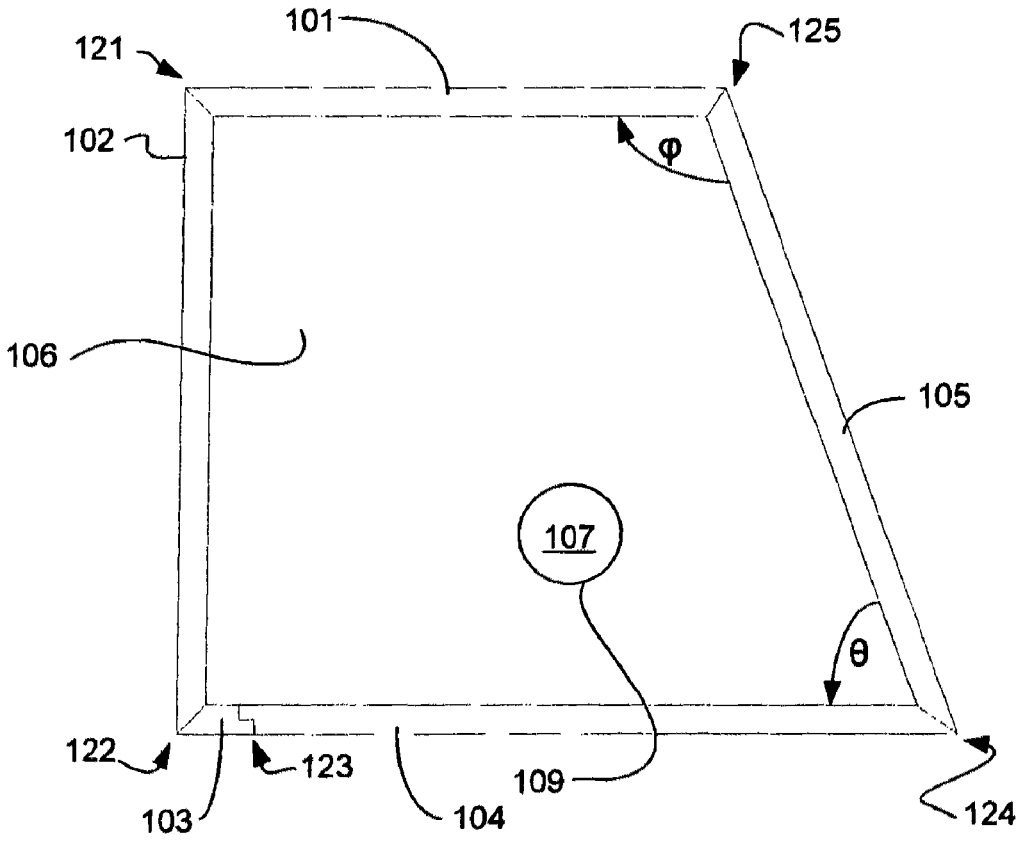
FIG. 3 is a side elevation view illustrating aspects of the assembled improved shippable speaker box of FIG. 1, according to an exemplary embodiment of the present invention.

FIG. 3 is a side elevation view illustrating aspects of the assembled improved shippable speaker box 100 of FIG. 1, according to an exemplary embodiment of the present invention. Acute angle $\theta$ and obtuse angle $\phi$ are supplementary angles and define the miter angles $\theta$ and $\phi$. The angles $\theta$ and $\phi$ may be chosen based upon acoustic principles within the constraints of folding dimensions, as discussed in more detail below. Note that the external length 604 (see FIG. 6) of bottom panel 104 is the slightly less than or equal to the external length 605 of back panel 105, which is important to the folding scheme discussed in more detail below. It is also important that the exterior length 601 of top panel 101 be no greater than the external length 602 of front panel 102.

Figure 4:
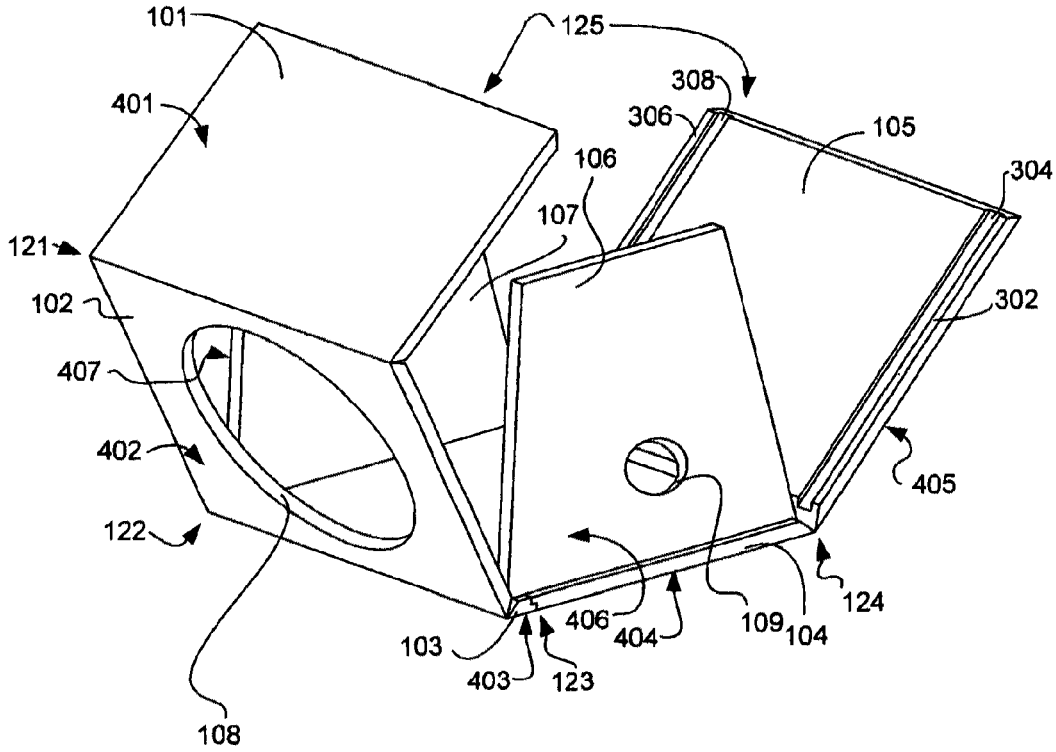
FIG. 4 is a front perspective view illustrating some aspects of the partially assembled improved shippable speaker box of FIG. 1, according to an exemplary embodiment of the present invention.

FIG. 4 is a front perspective view illustrating some aspects of the partially assembled improved shippable speaker box 100 of FIG. 1, according to an exemplary embodiment of the present invention. Grooves 304 and 308, illustrated here as rectangular grooves, but not so limited in the invention, extend in an aligned fashion into each of the five panels 101,102,103,104 and 105. The grooves 304 and 308 receive the side panels 106 and 107 as side panels 106 and 107 are circumferentially engaged by the five panels 101,102,103, 104 and 105. Groove 304 is set inward from the edge of the five panels 101,102,103,104 and 105 by a rim 302. Groove 308 is set inward from the edge of the five panels 101,102, 103,104 and 105 by a rim 306. In the present embodiment, grooves 304 and 308 have the same widths, but the invention is not so limited. In the present embodiment, rims 302 and 306 have the same widths, but the invention is not so limited.

Acutely mitered joint 124 and mitered joint 122 are shown open, and illustrate that the groove 304 extends the full length of panel 105, 104, and 103. Mitered joint 125 is open and is shown as two surfaces, but is not flexibly coupled by fabric 115. Rather, joint 125 is closed during assembly. External surfaces 401,402,403,404, 405,406 and 407 of panels 101, 102, 103,104,105, 106, and 107, respectively, are identified for reference in discussions below.

Figure 5:
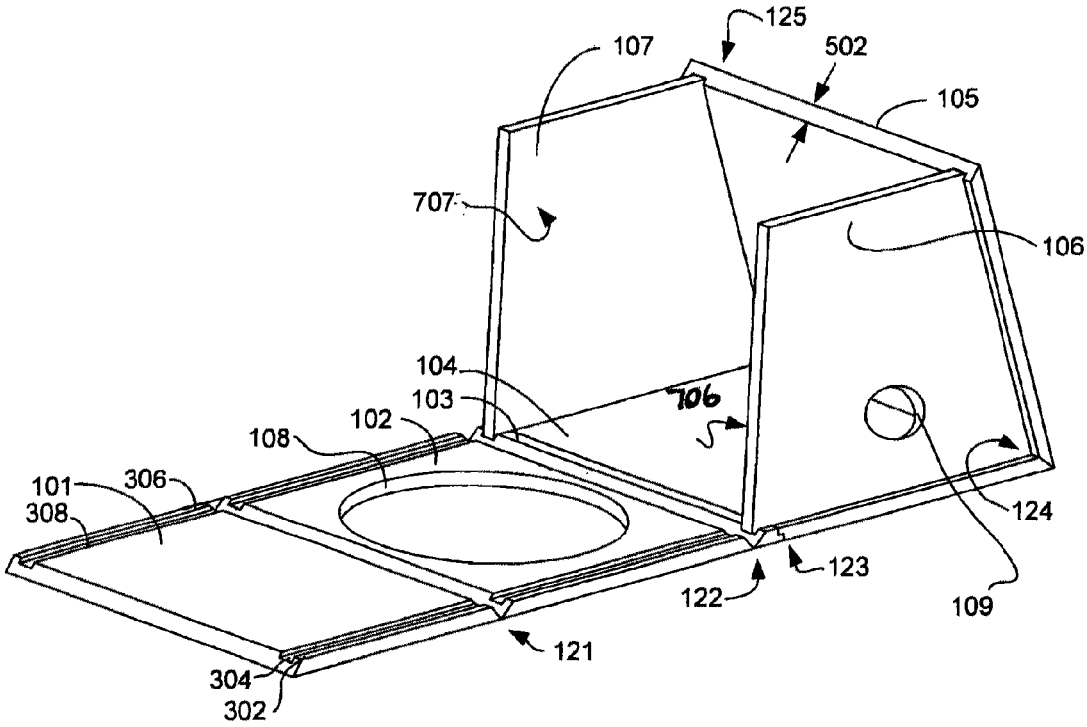
FIG. 5 is a front perspective view illustrating some additional aspects of the partially assembled improved shippable speaker box of FIG. 1, according to an exemplary embodiment of the present invention.

FIG. 5 is a front perspective view illustrating some additional aspects of the partially assembled improved shippable speaker box 100 of FIG. 1, according to an exemplary embodiment of the present invention. Grooves 304 and 308 are shown in panels 101 and 102, and can be partially seen in panel 103. Likewise, rims 302 and 306 are shown in panels 101 and 102, and can be partially seen in panel 103. The depth of grooves 304 and 308 is preferably less than one-half the thickness 502 of a panel 101, 102, 103, 104 or 105. Internal surface 706 of panel 106 and internal surface 707 of panel 107 are identified for reference in discussions below.

The speed of assembly is greatly improved by having the five panels 101, 102, 103, 104 and 105 coupled together in a linear arrangement that can be unfolded from the shipping stack 900 (see FIG. 9) and quickly refolded around the circumferences of the side panels 106 and 107. The joints 121, 122, 123, 124, and 125 properly align without special effort due to the combination of grooves 304 and 308 with the flexible coupling of the fabric 115.

In the stage of assembly illustrated in FIG. 5, panels 103, 104 and 105 have been engaged on the circumference of panels 106 and 107. Preferably, adhesive 1106 is applied in the grooves 304 and 308 before the panels 106 and 107 are engaged. Adhesive 1106 is preferably also applied to the joints 121,122, 123, 124, and 125, as speaker box 100 is assembled. Care should be taken not to overuse the adhesive 1106, as leakage to the outside may mar the appearance of the speaker box 100. Those of skill in the art, enlightened by this disclosure, will appreciate the various adhesives appropriate for this application, and its dependency on the type of panel materials. In an alternate embodiment, the adhesive may be a two-sided adhesive tape. In yet another embodiment, the adhesive may be an elastomeric adhesive tape that provides damping and adhesion. In still yet another embodiment, an acoustic damping material may be adhered into grooves 304 and 308, and then panels 106 and 107 may be adhered to the acoustic damping materials in the grooves 304 and 308.

Figure 6:
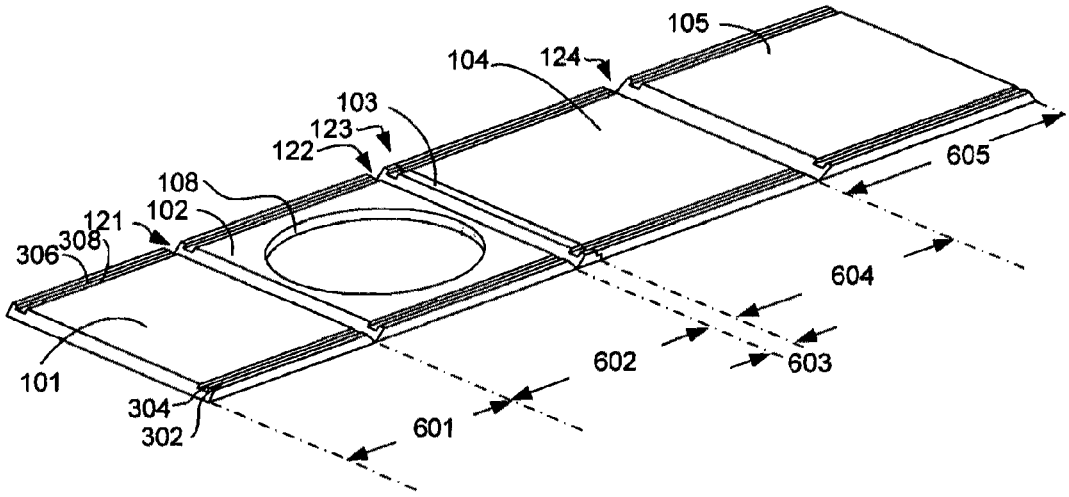
FIG. 6 is a front perspective view illustrating aspects of the five-panel foldable portion of the improved shippable speaker box of FIG. 1, according to an exemplary embodiment of the present invention.

FIG. 6 is a front perspective view illustrating aspects of the five-panel 101,102, 103, 104 and 105 foldable portion of the improved shippable speaker box 100 of FIG. 1, according to an exemplary embodiment of the present invention. The panels 101,102, 103, 104 and 105 are shown with their interior surfaces up. The panels 101, 102, 103, 104, and 105 are aligned, as is groove 304 and groove 308. The alignment of panels 101, 102, 103, 104 and 105 is maintained by fabric 115 (on exterior surfaces, not visible in this view). Carpet is a preferred fabric 115. Other fabric 115 may be used, such as leather, padded fabrics, chain mail, and the like. Other approaches to flexible couplings may be used. In an acoustically challenging embodiment, piano hinges may be used, hopefully with acoustic damping.

The view of FIG. 6 is the view of the five panels 101,102, 103,104 and 105 as they come off the assembly line. Initially one piece of main panel material, the main panel is cut to size, grooves 304 and 308 are cut into the remaining panel, and the angled mitered joints, as well as the rabbet portion of panel 104 are cut. The short panel 103 is cut and mitered for the angled miter on one end and the flat rabbet miter on the other. The panels 101,102,103,104 and 105 are aligned and the fabric 115 is applied. In an alternative embodiment, the fabric 115 is applied after the main panel is cut.

External lengths 601, 602, 603, 604 and 605 of panels 101, 102, 103, 104, and 105, respectively, have important relationships, as will be discussed more fully below.

Figure 7A:
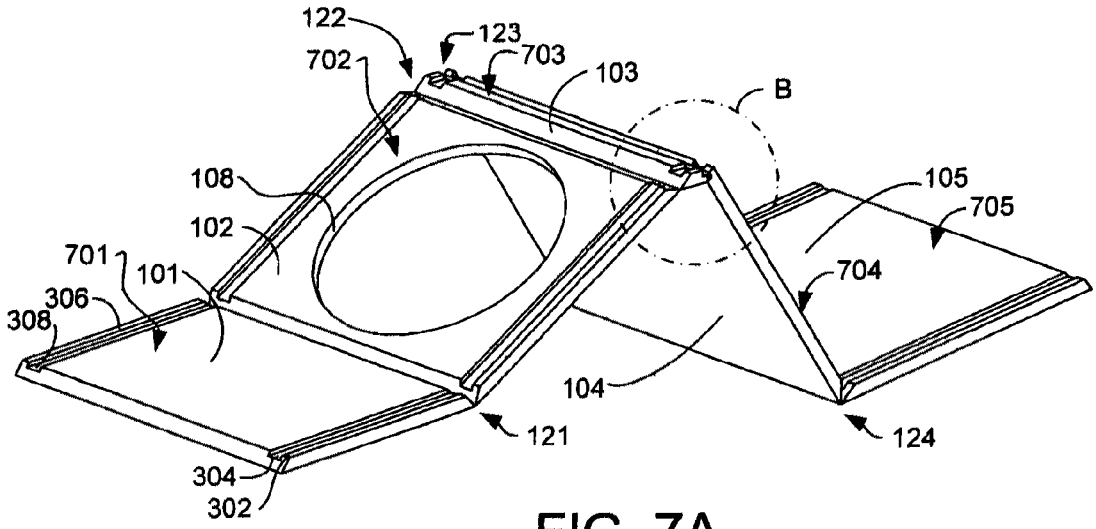
FIG. 7A is a front perspective view illustrating aspects of the five-panel foldable portion of the improved shippable speaker box of FIG. 1 in a partially folded configuration, designating detail B, according to an exemplary embodiment of the present invention.

FIG. 7A is a front perspective view illustrating aspects of the five-panel 101,102, 103, 104, and 105 foldable portion of the improved shippable speaker box 100 of FIG. 1 in a partially folded configuration, designating detail B, according to an exemplary embodiment of the present invention. In a first stage of folding for shipping, panels 101, 102, 103, 104 and 105 are raised by the short panel 103. Internal surfaces 701, 702, 703, 704, and 705 of panels 101, 102, 103, 104, and 105, respectively, are identified for reference in discussions below.

Figure 7B:
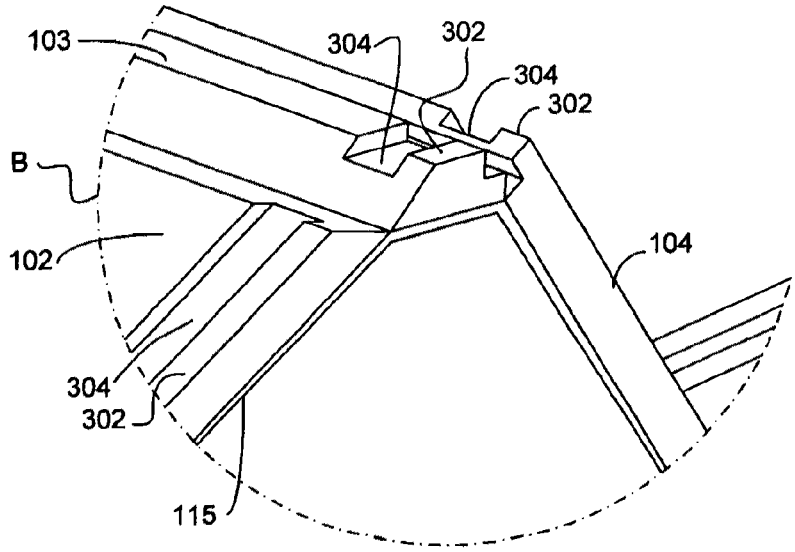
FIG. 7B is a front perspective view illustrating detail B, from FIG. 7A, of the five-panel foldable portion of the improved shippable speaker box of FIG. 1 in a partially folded configuration, according to an exemplary embodiment of the present invention.

FIG. 7B is a front perspective view illustrating detail B, from FIG. 7A, of the five-panel 101,102,103,104 and 105 foldable portion of the improved shippable speaker box 100 of FIG. 1 in a partially folded configuration, according to an exemplary embodiment of the present invention. Detail B shows the flexing of the rabbet joint 123 between short panel 103 and bottom panel 104 and the flexing of mitered joint 122 between panel 103 and panel 102. The layer of fabric 115 is in better view in detail B.

The flat rabbet joint 123 is a preferred joint that can be rotated at one outer edge. In a lesser preferred embodiment, a flat butt joint may be used, which simplifies manufacture (simple saw cut) but reduces structural stability. In a yet lesser preferred embodiment, a mitered joint, similar to joints 121 and 122, may be used, which simplifies manufacture (using the same router tool to make all mitered joints) but reduces structural stability even more, and requires cosmetic compensation to deal with the notch left on the exterior rim at the joint between short panel 103 and, bottom panel 104. The flat rabbet joint 123 is more complex to manufacture but gives excellent structural integrity and requires no cosmetic compensation.

Figure 8A:
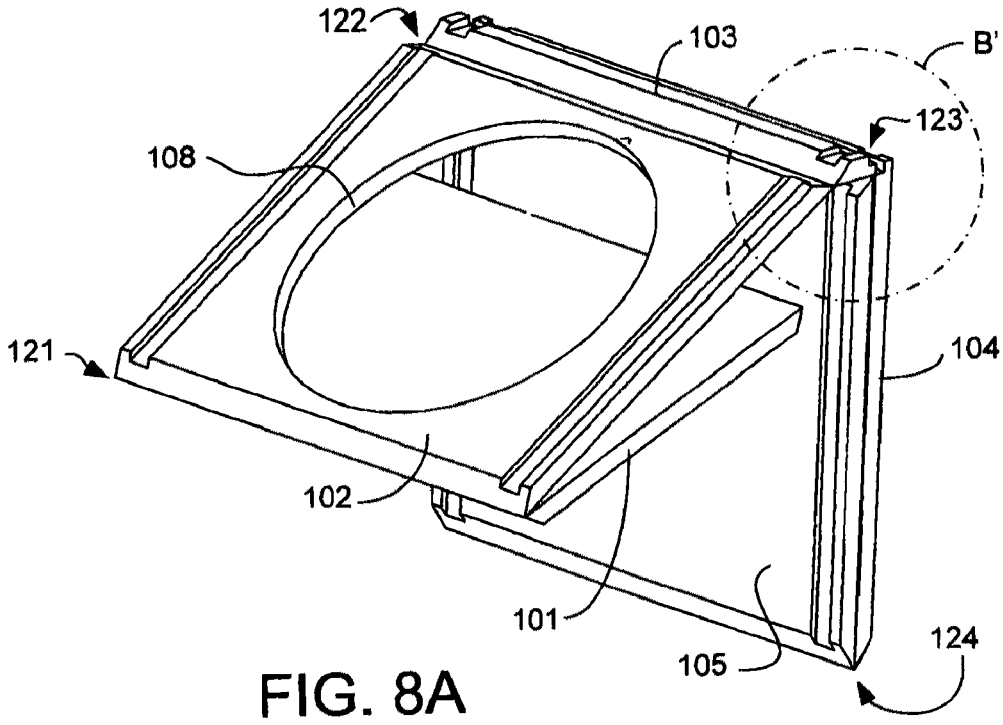
FIG. 8A is a front perspective view illustrating the five-panel foldable portion of the improved shippable speaker box of FIG. 1 in a further partially folded configuration, designating detail B', according to an exemplary embodiment of the present invention.

FIG. 8A is a front perspective view illustrating the five-panel 101, 102, 103, 104, and 105 foldable portion of the improved shippable speaker box 100 of FIG. 1 in a further partially folded configuration, designating detail B', according to an exemplary embodiment of the present invention. Panels 104 and 105 are folded to a configuration in which they are parallel and adjacent to one another. This illuminates the point that the length of short panel 103 is chosen to make a foldable size relationship between panels 104 and 105. That is, the external lengths 603, 604, and 605 of panels 103, 104, and 105, respectively, should be predetermined to allow back panel 105 to fold to a position adjacent and parallel to bottom panel 104. If short panel 103 is too long, bottom panel 104 may shorter than back panel 105, preventing back panel 105 from folding into the position shown. Accordingly, the external length 603 of short panel 103 should be selected to make bottom panel 104 longer than back panel 105. It should further be appreciated that the angles θ and ϕ, if not determined in light of folding constraints, may result in external lengths 605 and 604 of back panel 105 and bottom panel 104, respectively, that are inconsistent with folding.

Top panel 101 is partially folded under front panel 102. It can be seen that the external length 601 of top panel 101 must be less than the external length 602 of front panel 102 for the fold to be ultimately successful. Note that the panels 101 and 102 as well as panels 104 and 105 have their external surfaces 401 and 402 adjacent, as well as external surfaces 404 and 405 adjacent. Their internal surfaces 701, 702, 703, 704 and 705, ultimately hidden after assembly, are outward to receive any blemishes that may accrue during handling. In a particular embodiment where the fabric 115 is particularly subject to blemishes by rubbing, such as with a glossy polymeric fabric, a protective sheet may be inserted between the adjacent panels 101 and 102, or between adjacent panels 104 and 105 during shipping.

Figure 8B:
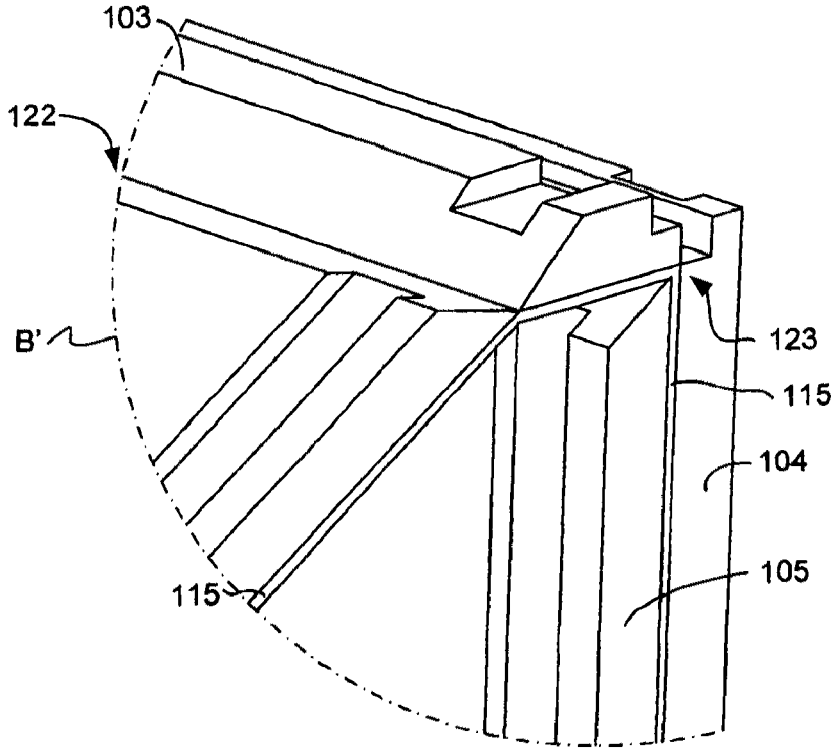
FIG. 8B is a front perspective view illustrating detail B', from FIG. 8A, of the five-panel foldable portion of the improved shippable speaker box of FIG. 1 in a further partially folded configuration, according to an exemplary embodiment of the present invention.

FIG. 8B is a front perspective view illustrating detail B7, from FIG. 8A, of the five-panel 101,102,103,104 and 105 foldable portion of the improved shippable speaker box 100 of FIG. 1 in a further partially folded configuration, according to an exemplary embodiment of the present invention. Detail B' shows flat mitered rabbet joint 123 open at 90 degrees of angle. Back panel 105 is folded to have its external surface 405, covered by fabric 115, adjacent to the external surface 404, also covered by fabric 115, of bottom panel 104. FIG. 8B illuminates that the exterior length 603 of short panel 103 must be at least twice the thickness 502 or the panels 101, 102, 103, 104, and 105, in addition to other constraints.

Figure 9A:
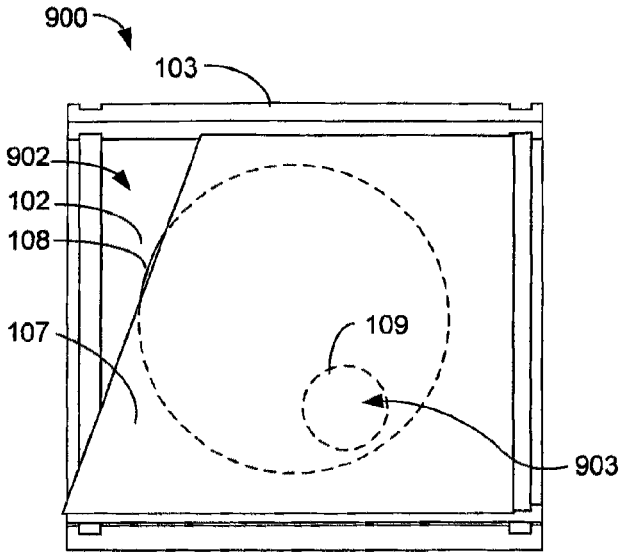
FIG. 9A is a side elevation view illustrating the improved shippable speaker box of FIG. 1 in a folded and stacked configuration, according to an exemplary embodiment of the present invention.

FIG. 9A is a side elevation view illustrating the improved shippable speaker box 100 of FIG. 1 in a folded and stacked configuration, according to an exemplary embodiment of the present invention. The stack 900 includes the five panels 101, 102, 103, 104, and 105, and the side panels 106 and 107. The advantage of having side panels 106 and 107 no larger in length and width than the largest of the top, front, bottom, and back panels 101,102,104, and 105, as shown, is that the side panels do not make the stack 900 any larger in length or width.

The internal surface 702 of panel 102 is preferably adjacent to internal surface 706 of the panel 106, such that the speaker opening 108 and the connector cup opening 109 form a stack void 903, in which some construction elements (not likely to mar external surface 707) for the speaker box 100 may be shipped. Panel 107, with its external surface 407 adjacent to external surface 706 of panel 106, closes the stack void 903 and maintains an internal surface 707 on the exterior of the stack 900. A box void 902 is formed which may be used for shipping construction elements with the stack 900 in a rectangular box. Note that, to get the sloped portions of side panels 106 and 107 to line up, either the external surfaces 406 and 407 must be adjacent or the internal surfaces 706 and 707 must be adjacent. The clear preference is for external surfaces 406 and 407 to be adjacent and protected, while the ultimately hidden internal surface 707 is on the exterior of the stack 900.

Figure 9B:
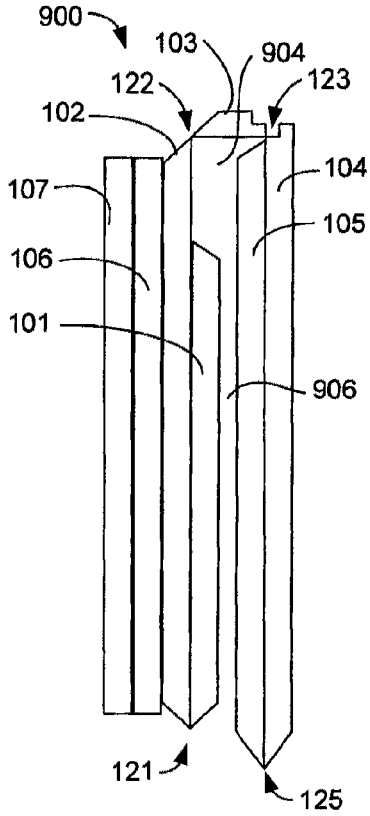
FIG. 9B is a side elevation view illustrating the improved shippable speaker box of FIG. 1 in a folded and stacked configuration, according to an exemplary embodiment of the present invention.

FIG. 9B is a side elevation view illustrating the improved shippable speaker box 100 of FIG. 1 in a folded and stacked configuration, according to an exemplary embodiment of the present invention. Two additional stack voids, 904 and 906, become apparent in this view. Stack void 906 may accommodate a set of instructions 1110 (see FIG. 11), while stack void 904 may accommodate bundle ties 110 and 113 with bundle tie locks 111 and 113, respectively, for shipping. In the most preferred embodiment, all of the construction elements are shipped in box voids, such as box void 902. At the point where the retail package for the product is filled, the stack 900 may already be bundled or shrink-wrapped, and so use of stack voids 903, 904, and 906 may be difficult.

Figure 9C:
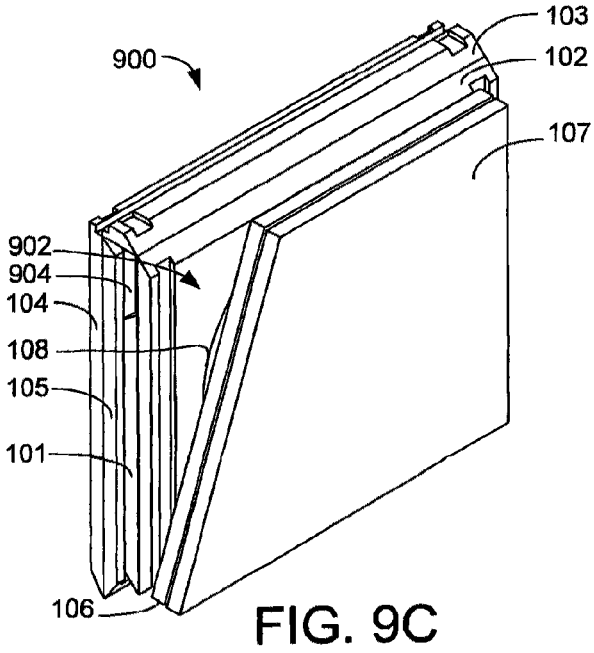
FIG. 9C is a front perspective view illustrating the improved shippable speaker box of FIG. 1 in a folded and stacked configuration, according to an exemplary embodiment of the present invention.

FIG. 9C is a front perspective view illustrating the improved shippable speaker box 100 of FIG. 1 in a folded and stacked configuration, according to an exemplary embodiment of the present invention. The short panel 103 must be the middle of the five panels 101, 102, 103, 104, and 105. In various alternate embodiments, the location of the short panel 103 may be re-arranged so that the short panel 103, instead of being coplanar with the bottom panel 104, is coplanar with any one of the top panel 101, front panel 102, or back panel 105 as long as the assembly joint (125, in the illustrated embodiment) is the third joint away from the short panel 103 in both directions. This leaves two foldable panels on each side of the short panel 103, and the folding approach may be used.

Figure 10:
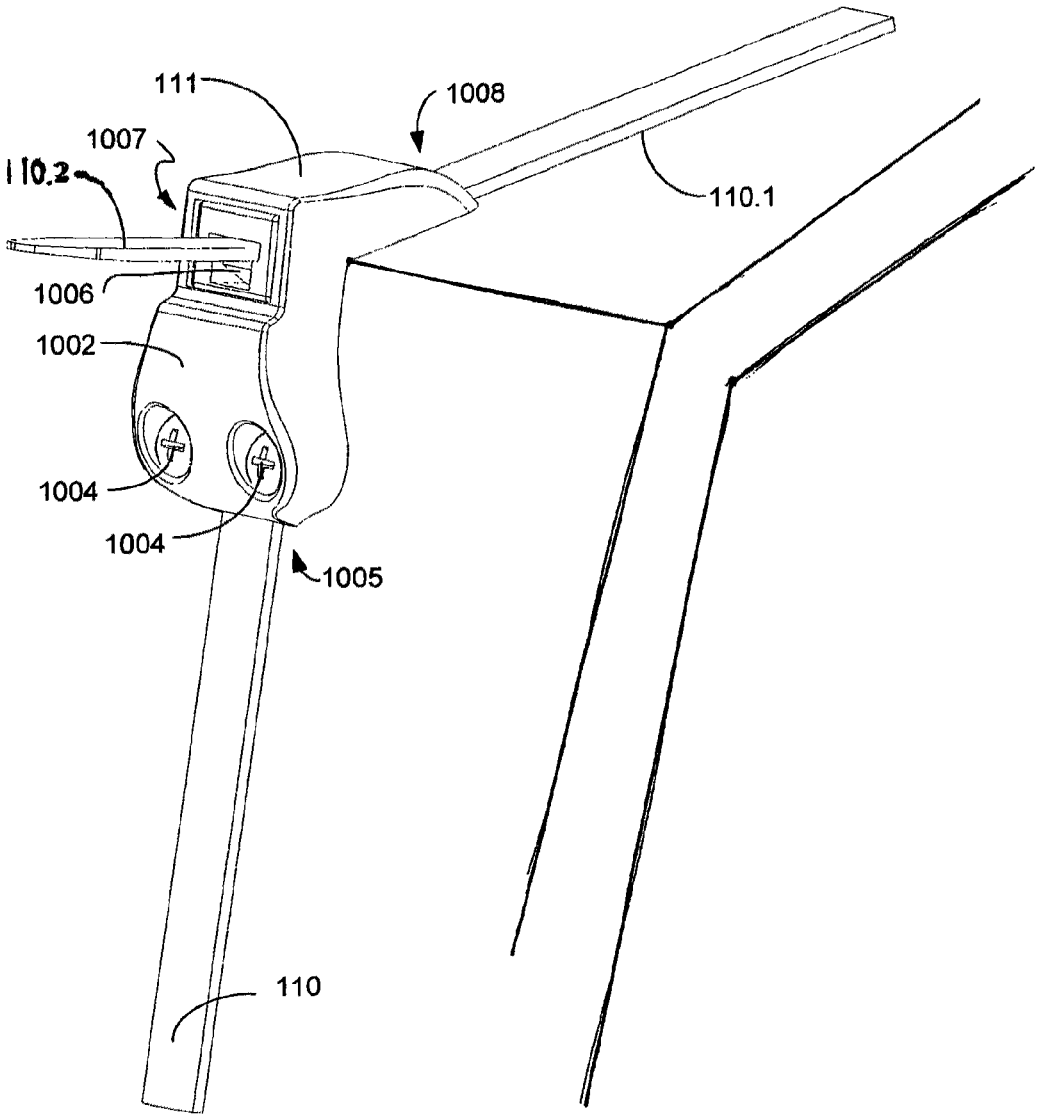
FIG. 10 is a rear perspective view illustrating an improved bundle tie clamp used with the improved shippable speaker box of FIG. 1, according to an exemplary embodiment of the present invention.

FIG. 10 is a rear perspective view illustrating an improved bundle tie lock 111 used with the improved shippable speaker box 100 of FIG. 1, according to an exemplary embodiment of the present invention. Bundle tie lock 111 is fastened to back panel 105 using fasteners 1004, which are accommodated by the lock 111 design. A first end of bundle tie 110 is fixed in the lock 111 and extends through end 1005 via an opening or notch. Bundle tie 110 extends around the speaker box 100 and has a lockable portion 110.1 which extends into an opening or notch in second end 1008 and threads through the internal locking mechanism 1006. A short extension 110.2 extends out of lock opening 1007.

Shoulder 1002 is reinforced underneath to make it operable as a fulcrum. In a preferred method of assembly, a pair of channel lock pliers is held with the jaws downward and grasping the tab 110.2. This would normally be the top jaw of the channel lock pliers is engaged with the underside of tab 110.2 and the outside of the jaw is resting on shoulder 1002. By clamping tab 110.2 tightly with the channel lock pliers and prying against shoulder 1002 to pull the tab 110.2 out of the lock 111, the bundle tie 110 can be tightened to a very high degree. After assembly, excess tab 110.2 may be trimmed away by any convenient means. Preferably, bundle tie 110 is tightened before any adhesive used to adhere the side panels 106 and 107 sets. In an alternate embodiment, where the option to disassemble the speaker box 100 is desired, the adhesive may be omitted and tab 110.2 not trimmed (for reuse later). The lock may be released, albeit with some difficulty, by depressing lock 1006 away from bundle tie 110.1 with a small rigid tool, such as an ice pick or a screwdriver.

Bundle ties 110 and 112 may be above fabric 115, as shown in FIG. 2, or may be underneath the fabric 115 for all portions except tab 110.2. If not below the fabric 115, the bundle ties 110 and 112 may be decorative. For example, and without limitation, bundle ties 110 and 112 may be colored, metallic, pearlescent, clear, may include a design, or may include inclusions in a non-opaque substrate. In an alternate embodiment, only one bundle tie 110 may be used. In various alternate embodiments, more than two bundle ties 110 and 112 may be used.

Figure 11:
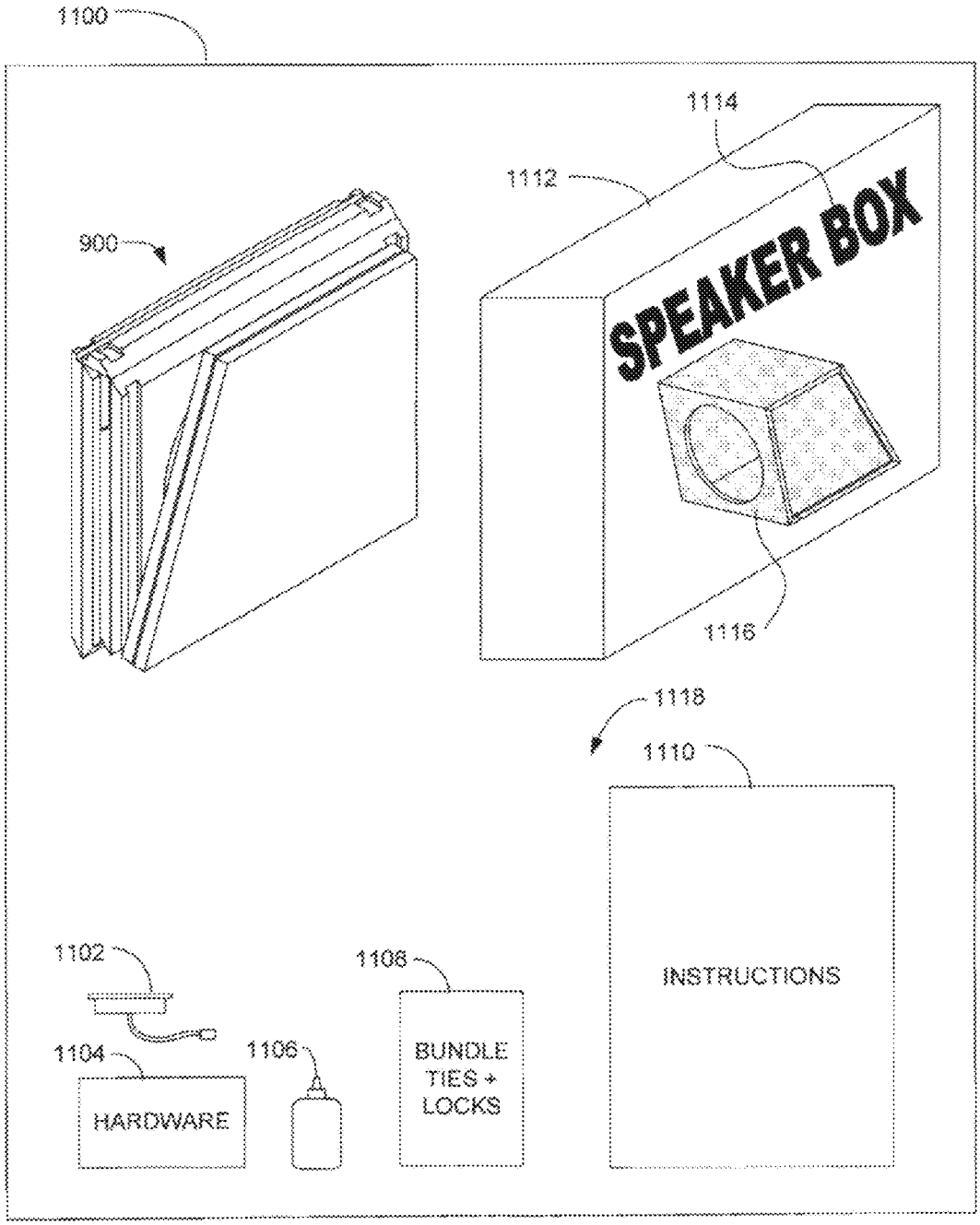
FIG. 11 is a diagrammatic view of a shipping kit for the improved shippable speaker box of FIG. 1, according to an exemplary embodiment of the present invention.

FIG. 11 is a diagrammatic view of a shipping kit 1100 for the improved shippable speaker box 100 of FIG. 1, according to an exemplary embodiment of the present invention. Kit 1100 includes a stack 900, construction elements 1118 for assisting in assembly, and may include a retail package 1112. Construction elements 1118 may include a connector cup 1102, an adhesive 1106, a package 1108 containing bundle ties 110 and 112 with bundle tie locks 111 and 113, and a set of instructions 1110. The set of instructions 1110 may include instructions in multiple languages. The adhesive 1106 may be of any type or form appropriate for the materials being adhered. The preferred bundle ties 110 and 112 with bundle tie locks 111 and 113 are illustrated in FIG. 2 and FIG. 10. Optional hardware package 1104 may include fasteners 1004, or fasteners 1004 maybe included in package 1108. If mounting hardware is used with a particular embodiment, such as to mount the speaker box 100 to a wall or ceiling, that hardware may be included in hardware package 1104. In a preferred embodiment, the fasteners 1004 are packaged with the bundle ties 110 and 112 with bundle tie locks 111 and 113 and there is no package 1104. In an alternate embodiment, all or part of the set of instructions may be printed on one or more interior surfaces 701,702, 704, 705, 706, and/or 708. If the stack 900 is not bound or shrink-wrapped at the kit 1100 assembly point, at least some of the construction elements 1118 may be packed in stack voids 903, 904, and 906. In a preferred embodiment, construction elements may be packed in box voids, such as box void 902.

While at least one exemplary embodiment has been presented in the foregoing detailed description, it should be appreciated that a vast number of variations exist. It should be recognized that the specific arrangements and configurations for various container supports with tool could vary greatly and the embodiments of the invention are not limited to any particular configuration or arrangement shown in the example embodiments.

Unless contrary to physical possibility, the inventor envisions the components of respective embodiments may be combined in any manner.

Although there have been described preferred embodiments of this novel invention, many variations and modifications are possible and the embodiments described herein are not limited by the specific disclosure above, but rather should be limited only by the scope of the appended claims.

What I claim is:

1. A shippable speaker box, comprising:

five panels flexibly coupled in a linearly aligned arrangement with four flexible couplings, wherein one of said four flexible couplings comprises a mitered flat rabbet joint; and said five panels are operable to be folded together into a configuration wherein four panels of said five panels are stacked generally parallel to each other without uncoupling said four flexible couplings;

a first side panel sized and shaped to be circumferentially engaged by said five panels; and a second side panel sized and shaped to be circumferentially engaged by said five panels.

2. The speaker box of claim 1, combined in a kit comprising:

a configuration wherein four panels of said five panels are aligned in parallel and said four flexible couplings remain coupled; the first and second side panels stacked parallel to the four parallel panels to form a stack;

at least one bundle tie having a bundle tie lock; and at least one construction element.

3. The speaker box of claim 2, wherein said bundle tie lock comprises a reinforced shoulder operable to be used as a fulcrum for a channel lock pliers to tighten said bundle tie circumferentially around said speaker box.

4. The speaker box of claim 2, wherein each of said five panels have a thickness and the five panels comprise:

one middle panel;

two intermediate panels flexibly coupled to said middle panel on opposite sides of said middle panel;

two outermost panels flexibly coupled to respective two of said intermediate panels to form the linearly aligned arrangement; and wherein said middle panel comprises an external length at least twice of its thickness, a flat rabbet joint joining a first intermediate panel; and an external length less than external lengths of said two intermediate panels and said two outermost panels.

5. The speaker box of claim 4, wherein the outermost panels have smaller external lengths than said intermediate panels to which said outermost panels are respectively coupled and wherein, when assembled into said speaker box, said middle panel is coplanar with said first intermediate panel.

6. The speaker box of claim 2, wherein at least one of the first or second side panels includes a connector cup opening sized and located to receive a connector cup and wherein said kit further comprises said connector cup; and wherein one of said four of the five panels includes a speaker opening sized and located to receive a speaker.

7. The speaker box of claim 6, wherein the side panel including the connector cup opening and the panel including the speaker opening are adjacent in said stack; wherein said connector cup opening and said speaker opening form a stack void within the stack; and wherein at least one construction element of said kit is packaged to be shipped within the stack void.

8. The speaker box of claim 6, wherein said kit further comprises:

a retail package configured to contain the stack, the at least one construction element, the connector cup, and the at least one bundle tie, wherein the retail package bears text relating to the speaker box; and graphics relating to the speaker box.

9. The speaker box of claim 2, wherein said at least one construction element of said kit comprises at least one of: adhesive, assembly hardware and instructions.

10. The speaker box of claim 1, further comprising first and second aligned grooves in each panel of said five panels, wherein said grooves are configured to receive at least a portion of the first and second side panels, respectively.

11. The improved shippable speaker box of claim 1, wherein said four flexible couplings comprise one piece of flexible fabric coupled to the five panels.

12. A shippable speaker box, comprising:

five panels each having a thickness and being flexibly coupled in a linear sequence with four flexible couplings, at least one of the four flexible couplings comprising a mitered flat rabbet joint; and wherein the five panels are arranged to be folded together into a configuration having four of the five panels stacked substantially parallel to each other without uncoupling said four flexible couplings; the five panels comprising:

a middle panel;

two intermediate panels flexibly coupled to said middle panel on opposite sides of said middle panel; and two outermost panels flexibly coupled to respective intermediate panels to form the linear sequence, and having smaller external lengths than the intermediate panels to which said outermost panels are respectively coupled;

a sixth panel, comprising a first side panel sized and shaped to be circumferentially engaged by said five panels;

a seventh panel, comprising a second side panel sized and shaped to be circumferentially engaged by said five panels;

wherein the middle panel has an external length at least twice its thickness but less than external lengths of the two intermediate panels and the two outermost panels, the middle panel including a flat rabbet joint joining with a first one of the intermediate panels; and wherein, when assembled into said speaker box, the middle panel is coplanar with said first one of intermediate panels; wherein one of the sixth or seventh panels includes a connector cup opening to receive a connector cup; wherein one of the four of five stacked panels includes a speaker opening to receive a separately provided speaker; wherein the five panels are operable to be folded to form four sides of said speaker box by:

i. circumferentially engaging said sixth and said seventh panels; and ii. securing the sixth and seventh panels to said five panels with at least one of adhesive or at least one bundle tie having a bundle tie lock;

wherein said five panels are operable to be folded into said configuration and said sixth panel and said seventh panel are operable to be stacked parallel and adjacent to said five folded panels to form a stack.

13. The shippable speaker box of claim 12, combined in a kit comprising:

the stack; and the at least one bundle tie.

14. The shippable speaker box of claim 13, wherein said kit further comprises at least one construction element comprising at least one of the connector cup, the adhesive, hardware and instructions.

15. The shippable speaker box of claim 14, wherein the kit further comprises a package enclosing the stack and having text relating to said speaker box and graphics relating to said speaker box.

16. The shippable speaker box of claim 15, wherein the stack contained in the package has at least one void to hold the construction element to be shipped therein.

17. The shippable speaker box of claim 12, wherein said four flexible couplings comprise one piece of flexible fabric coupled between the five panels.

18. The shippable speaker box of claim 12, further comprising first and second aligned grooves in each of the five panels, wherein said grooves are configured to receive a portion of said sixth and seventh panels, respectively.

19. The shippable speaker box of claim 12, wherein said bundle tie lock comprises a reinforced shoulder, said shoulder operable to be used as a fulcrum for a channel lock pliers to tighten said bundle tie circumferentially around said speaker box.

20. A shippable speaker box, comprising:

five panels flexibly coupled to each other in a linearly aligned sequence with four flexible couplings comprising pieces of flexible fabric and at least one flexible coupling comprising a mitered flat rabbet joint, the five panels operable to be folded together into a configuration where four of the five panels are stacked generally parallel to each other without uncoupling the four flexible couplings; wherein the five panels comprise:

a middle panel;

two intermediate panels flexibly coupled to said middle panel on opposite sides of said middle panel; and two outermost panels flexibly coupled to respective two of said intermediate panels to form said linear arrangement, the two outermost panels having smaller external lengths than the intermediate panels to which said outermost panels are respectively coupled;

wherein said middle panel includes an external length at least twice that of its thickness, a flat rabbet joint joining a first intermediate panel; and an external length less than external lengths of the two intermediate panels and the two outermost panels; and wherein, when assembled into said speaker box, the middle panel is coplanar with said first intermediate panel;

a sixth panel, comprising a first side panel to be circumferentially engaged by said five panels;

a seventh panel, comprising a second side panel to be circumferentially engaged by said five panels;

wherein the five panels each include first and second aligned grooves to receive a portion of said first and said second side panels respectively;

wherein one of the first or second side panels includes a connector cup opening to receive a connector cup;

wherein one of the four of five panels stacked parallel to each other includes a speaker opening to receive a separately provided speaker;

wherein the shippable speaker box may be rapidly assembled by:

i. circumferentially engaging said sixth and said seventh panels; with the flexibly connected five panels; and ii. securing all panels together with at least one of adhesive or a bundle tie having a bundle tie lock;

wherein the five panels are operable to be folded into a shipping configuration and said sixth panel and said seventh panel are operable to be stacked parallel and adjacent to said five folded panels to form a stack.

* * * * *